US008490219B2

(12) United States Patent
Seguin et al.

(10) Patent No.: US 8,490,219 B2
(45) **Date of Patent: *Jul. 23, 2013**

(54) PROTECTIVE GARMENT COMPRISING AT LEAST ONE TAPERED POCKET

(75) Inventors: Catherine Seguin, Montreal (CA); Anthony Di Giovanni, Kirkland (CA); Claude Barbeau, St-Bruno (CA)

(73) Assignee: Honeywell International Inc., Morristown, NJ (US)

( * ) Notice: Subject to any disclaimer, the term of this patent is extended or adjusted under 35 U.S.C. 154(b) by 28 days.

This patent is subject to a terminal disclaimer.

(21) Appl. No.: 12/774,238

(22) Filed: May 5, 2010

(65) Prior Publication Data

US 2010/0212062 A1 Aug. 26, 2010

Related U.S. Application Data

(63) Continuation of application No. 11/114,382, filed on Apr. 26, 2005, now Pat. No. 7,784,109.

(51) Int. Cl.
*A41D 27/20* (2006.01)
*A62B 17/00* (2006.01)

(52) U.S. Cl.
USPC ..... 2/247; 2/81

(58) Field of Classification Search
USPC ..... 2/458, 81, 85, 87, 92, 93, 94, 97, 2/102, 247, 249, 250, 241, 252, 248
See application file for complete search history.

(56) References Cited

U.S. PATENT DOCUMENTS

| | | | | | |
|---|---|---|---|---|---|
| 703,684 | A | * | 7/1902 | Wade | 2/102 |
| 791,676 | A | | 6/1905 | Dodshon | |
| D81,216 | S | | 5/1930 | Werber | |
| 1,951,240 | A | | 3/1934 | Gold | |
| 1,970,110 | A | | 8/1934 | Vaccaro | |
| 2,037,918 | A | * | 4/1936 | Papageorge | 2/96 |
| 2,133,601 | A | | 10/1938 | Ward | |
| 2,137,085 | A | * | 11/1938 | Hirschfeld | 2/102 |
| 2,137,086 | A | * | 11/1938 | Hirschfeld | 2/102 |
| 2,235,812 | A | * | 3/1941 | Greenberg | 2/85 |
| 2,236,694 | A | | 4/1941 | Oppenheimer | |
| 2,240,902 | A | * | 5/1941 | Flshman | 2/115 |
| 2,265,101 | A | | 12/1941 | Crego | |
| 2,364,258 | A | * | 12/1944 | Wallace | 2/92 |
| 2,472,286 | A | | 6/1949 | Drasnin | |

(Continued)

FOREIGN PATENT DOCUMENTS

CA 2 396 841 C 10/2007

OTHER PUBLICATIONS

USPTO OA mailed Mar. 11, 2008 for parent U.S. Appl. No. 11/114,382.

(Continued)

*Primary Examiner* — Alissa L Hoey
(74) *Attorney, Agent, or Firm* — Wood, Phillips, Katz, Clark & Mortimer

(57) ABSTRACT

A firefighter jacket that comprises a torso-covering portion and a pair of sleeves, wherein at least one pocket is positioned on the torso-covering portion. The pockets comprise an interior chamber and an opening to the interior chamber. The interior chamber has a width and a depth that varies along the width. The opening to the interior chamber is of a width that is less than the width of the interior chamber.

27 Claims, 4 Drawing Sheets

U.S. PATENT DOCUMENTS 2,579,383 A * 12/1951 Goudsmit ..... 219/211
2,593,711 A 4/1952 Weatherly
2,620,479 A * 12/1952 Buck ..... 2/94
2,715,226 A * 8/1955 Weiner ..... 2/79
2,841,794 A * 7/1958 De Grazia ..... 2/247
3,049,719 A 8/1962 Carmen
3,077,604 A 2/1963 Colangelo
3,086,215 A * 4/1963 Di Paola ..... 2/93
3,217,335 A 11/1965 Bell
3,435,462 A 4/1969 Bank
3,782,614 A 1/1974 Campisi
4,141,082 A 2/1979 Nakazawa et al.
4,149,272 A * 4/1979 Maeshima ..... 2/102
4,217,663 A * 8/1980 Goldberg et al. ..... 2/102
4,262,832 A * 4/1981 Perkins ..... 224/605
4,302,850 A * 12/1981 Maeshima ..... 2/102
4,404,689 A 9/1983 DeWan
4,507,802 A 4/1985 Small
4,525,879 A 7/1985 Kalomeris
4,603,441 A 8/1986 Richter
4,627,112 A 12/1986 Grilliot et al.
4,638,579 A 1/1987 Gamm
4,651,348 A * 3/1987 Swanson ..... 2/93
4,689,831 A 9/1987 Greenberger et al.
4,882,786 A 11/1989 Gross
4,910,069 A 3/1990 Isoe et al.
4,959,876 A 10/1990 Kalaam et al.
5,014,360 A 5/1991 Smith et al.
5,075,900 A * 12/1991 Chittenden ..... 2/94
5,124,190 A 6/1992 Isoe et al.
5,188,267 A 2/1993 Sargent et al.
5,496,205 A 3/1996 Lee
5,517,696 A 5/1996 Krugler
5,542,124 A 8/1996 Grilliot et al.
5,555,566 A 9/1996 Kuhn
5,638,549 A 6/1997 Thomas
5,673,836 A * 10/1997 Bush ..... 224/576
5,729,832 A 3/1998 Grilliot et al.
5,771,496 A 6/1998 Wood
5,842,229 A * 12/1998 Snedeker ..... 2/98
5,884,332 A 3/1999 Snedeker
5,884,338 A 3/1999 Golde
5,909,802 A 6/1999 Puco et al.
D414,913 S * 10/1999 Katz et al. ..... D2/829
6,012,167 A 1/2000 De Rosa et al.
6,014,772 A 1/2000 Connelly
6,029,270 A 2/2000 Ost et al.
6,119,269 A 9/2000 Imler et al.
6,131,199 A 10/2000 Bugel et al.
6,134,713 A 10/2000 De Rosa et al.
6,154,888 A 12/2000 Krohn
6,272,684 B1 * 8/2001 Shih ..... 2/87
6,298,485 B1 10/2001 Heller
6,324,697 B1 * 12/2001 Shofner ..... 2/102
6,334,221 B1 1/2002 Hope
6,405,376 B1 6/2002 Falk et al.
6,477,711 B1 11/2002 Freeman et al.
6,662,372 B2 12/2003 Lewis et al.
D491,713 S 6/2004 Wilson, II
6,839,915 B2 1/2005 Yoshimura
D506,594 S * 6/2005 Corris ..... D2/829
6,978,480 B2 12/2005 Grilliot et al.
6,986,164 B1 1/2006 Morales
7,143,450 B2 12/2006 Green, III
7,152,247 B2 12/2006 Parsons
7,356,850 B2 4/2008 Turcotte et al.
D580,630 S * 11/2008 Adams et al. ..... D2/829
7,543,338 B2 * 6/2009 Culhane ..... 2/93
7,784,109 B2 * 8/2010 Seguin et al. ..... 2/93
7,908,675 B2 * 3/2011 Robinson ..... 2/247
2002/0189000 A1 12/2002 Jordan
2003/0213043 A1 11/2003 Lewis et al.
2004/0055069 A1 3/2004 Clarke Fayle et al.
2004/0133962 A1 * 7/2004 Baumel ..... 2/108
2004/0187183 A1 9/2004 Hautala
2005/0235398 A1 10/2005 Yoo
2006/0277653 A1 12/2006 Okajima
2008/0184454 A1 8/2008 Collier
2008/0201816 A1 * 8/2008 Elliot ..... 2/51
2008/0256690 A1 10/2008 Grilliot et al.
2009/0172861 A1 * 7/2009 Tomlinson et al. ..... 2/85

OTHER PUBLICATIONS

USPTO OA mailed Nov. 18, 2008 for parent U.S. Appl. No. 11/114,382.
USPTO OA mailed Apr. 14, 2009 for parent U.S. Appl. No. 11/114,382.
USPTO OA mailed Jul. 17, 2009 for parent U.S. Appl. No. 11/114,382.
USPTO OA mailed Jan. 15, 2010 for parent U.S. Appl. No. 11/114,382.
Canadian Office Action issued Sep. 9, 2010 in connection with Canadian Patent Application No. 2,505,320.

* cited by examiner

PROTECTIVE GARMENT COMPRISING AT LEAST ONE TAPERED POCKET

CROSS-REFERENCE TO RELATED APPLICATIONS

The present application claims the benefit of domestic priority under 35 USC 120 as being a continuation application of U.S. patent application Ser. No. 11/114,382 filed on Apr. 26, 2005 entitled "Protective Garment with Tapered Pockets", the contents of which are incorporated herein by reference.

FIELD OF THE INVENTION

The present invention relates to the field of protective garments. More specifically, the present invention relates to the field of protective garments for firefighters, wherein the protective garments have side pockets that vary in depth.

BACKGROUND OF THE INVENTION

Ideally, protective garments for firefighters should be designed to provide the firefighter with both protection and functionality. Unfortunately, while many protective garments are designed to protect against the harsh environmental conditions to which the firefighters are exposed, not many protective garments are designed to provide the firefighters with improved functionality that could facilitate their jobs.

In order to provide good functionality in a firefighter's outer jacket, it is important that the jacket be relatively flexible and free of protrusions. Flexibility is important for permitting the firefighter to move freely and comfortably during the course of routine operations, and the absence of protrusions is important for preventing the jacket from snagging or catching on things while the firefighter is working. The jacket must also provide the firefighter with the ability to carry the necessary tools of the trade, such as flashlights and screwdrivers. To this end, many existing firefighter jackets include pockets for carrying the firefighter's various tools.

A deficiency with the pockets of existing firefighter jackets is that they generally hinder the functionality of the jacket, more than they help. Most firefighter jackets include two large pockets that are sewn directly onto the outer material of the jacket. Furthermore, these pockets are generally located at the bottom front of the jacket. It has been found that these pockets cause two major problems. The first problem is that once the firefighter has placed his/her tools within the pockets, the pockets become bulky. This additional bulk and weight at the front of the jacket prevents the firefighter from being able to bend over and move comfortably, which restricts the firefighter's flexibility. The second problem is that once these pockets are full, they protrude outwardly from the front of the jacket. This means that they can easily snag and catch on things, which can be very dangerous for the firefighter. In addition, the additional bulk at the front of the firefighter's jacket can prevent the firefighter from being able to squeeze through tight doorways, and other confined spaces, which during an emergency situation can cause the firefighter to lose precious time.

In light of the above, it can be seen that there is a need in the industry for a firefighter jacket that alleviates, at least in part, the deficiencies mentioned above that are associated with existing firefighter jackets.

SUMMARY OF THE INVENTION

In accordance with a first broad aspect, the present invention provides a firefighter jacket that comprises a torso-covering portion and at least one pocket positioned on the torso-covering portion. The pockets include an interior chamber and an opening to the interior chamber. The interior chamber has a width and a depth that varies along the width.

In accordance with a second broad aspect, the present invention provides a firefighter jacket that comprises a torso covering portion and at least one pocket positioned on the torso-covering portion. The torso-covering portion has a front side, a back side and a pair of sleeves, wherein the back-side is longer than the front side. The pockets positioned on the torso-covering portion extend from the front side towards the back side, and define an interior chamber that has a first width. The pocket comprises an opening to the interior chamber. The opening has a second width, wherein said first width is greater than the second width.

In accordance with a third broad aspect, the present invention provides a firefighter jacket comprising a torso-covering portion, and a pocket. The torso-covering portion comprises a front-side and a back-side, wherein the back-side is longer than the front-side and a pair of sleeves. The pocket comprises an interior chamber having a width and a depth, wherein the depth of the interior chamber is greater towards the back-side of the torso-covering portion than towards the front-side of the torso-covering portion, and a bottom edge of the pocket follows a bottom edge portion of the firefighter jacket.

In accordance with a fourth broad aspect, the invention provides a firefighter jacket comprising a torso-covering portion and at least one pocket. The torso-covering portion comprises a front-side and a back-side, wherein the back-side is longer than the front-side, and a pair of sleeves. Each of the at least one pocket extends from the front-side of the torso-covering portion to the back-side of the torso-covering portion and comprises an interior chamber having a width and a depth, wherein the depth increases from the front-side to the back-side of the torso-covering portion, and a bottom edge that slopes from the front-side of the torso-covering portion towards the back-side of the torso-covering portion, such that items placed within the at least one pocket during wear of the firefighter jacket are caused to locate themselves towards the back-side of the torso-covering portion.

In accordance with a fifth broad aspect, the invention provides a firefighter jacket comprising a torso-covering portion and a pocket. The torso-covering portion comprises a front-side and a back-side, wherein the back-side is longer than the front-side and a pair of sleeves. The pocket comprises an interior chamber having a width and a depth, wherein the depth of the interior chamber is greater towards the back-side of the torso-covering portion than towards the front-side of the torso-covering portion. The pocket further comprises a frontal side edge and a back side edge, wherein the back side edge of the pocket is longer than the frontal side edge, and a pleat positioned between the frontal side edge and the back side edge.

These and other aspects and features of the present invention will now become apparent to those of ordinary skill in the art upon review of the following description of specific embodiments of the invention and the accompanying drawings.

Other aspects and features of the present invention will become apparent to those ordinarily skilled in the art upon review of the following description of specific embodiments of the invention in conjunction with the accompanying figures.

DETAILED DESCRIPTION

Figure 1:
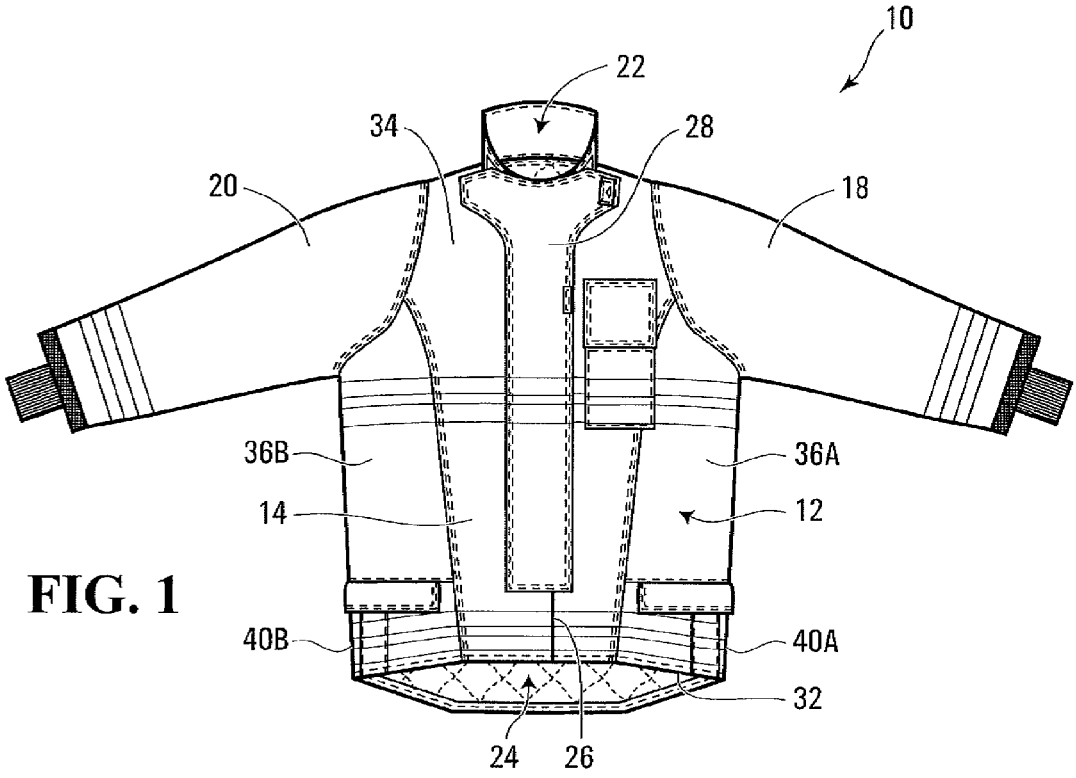
FIG. 1 shows a front plan view of a firefighter jacket in accordance with a non-limiting example of implementation of the present invention.
Figure 2:
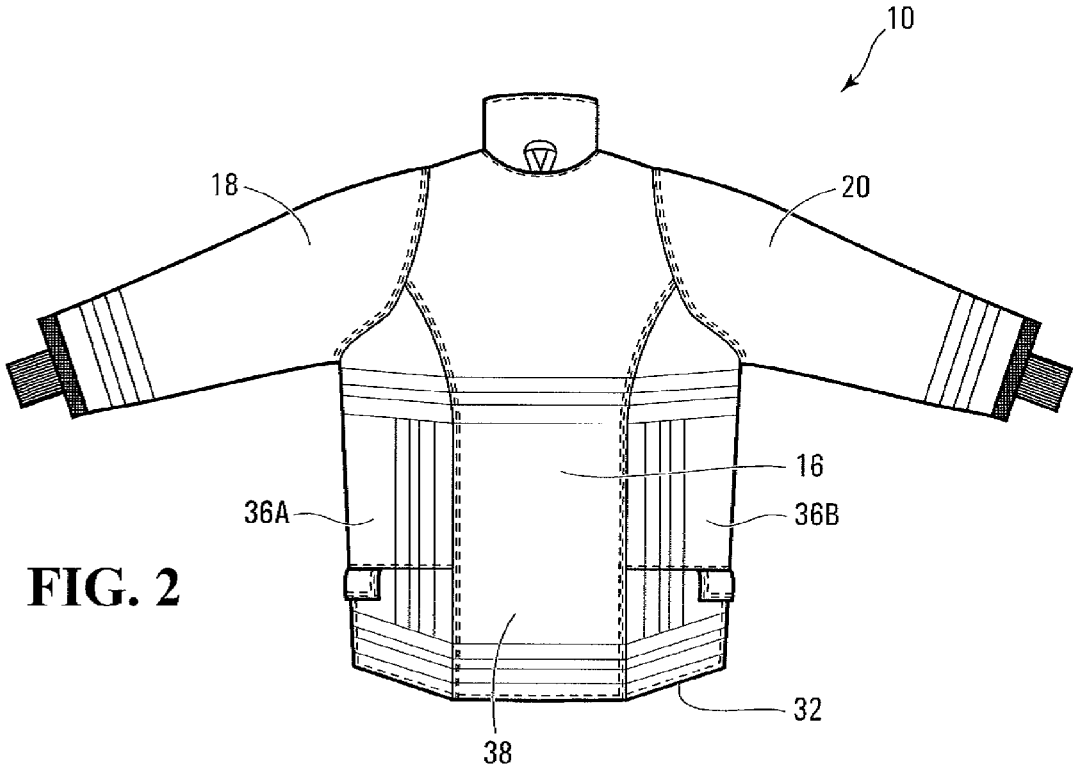
FIG. 2 shows a back plan view of the firefighter jacket of FIG. 1.

Shown in FIGS. 1 and 2 is an outer jacket 10 in accordance with a non-limiting example of implementation of the present invention, the outer jacket 10 is suitable for use as a protective garment for a firefighter and comprises a torso-covering portion 12 and first and second sleeves 18 and 20. The torso-covering portion 12 has first and second openings O1, O2, each with a diameter and at which the first and second sleeves 18, 20 are connected and through which a wearer's arms project into the sleeves 18, 20 with the jacket 10 worn. The torso-covering portion 12 includes a front side 14, a back side 16, a head opening 22, a lower-trunk opening 24 and a frontal opening 26 which extends from the head opening 22 to the lower-trunk opening 24. The torso-covering portion 12 has opposite like side portions SP1, SP2, with representative side portion SP1 below the opening O1 and within a space between parallel vertical lines L1, L2 spaced a distance equal to the diameter of the opening O1 and containing the opening O1. The side portion SP2 resides between corresponding vertical lines L3, L4 on the opposite side of the jacket 10. The side portions SP1, SP2 having widths respectively between the vertical lines (L1, L2 for side portion SP1).

In the embodiment shown in FIG. 1, the frontal opening 26 is shown in the closed position. It should be understood that the frontal opening 26 can be opened and closed such that a wearer can don and un-don the outer jacket 10. In accordance with a non-limiting embodiment, the frontal opening 26 is closable via a zip, however, any other fastening device known in the art, such as Velcro™, poppers or buttons could also be used without departing from the spirit of the invention. In the embodiment shown in FIG. 1, the frontal opening 26 is further covered via a flap 28 for additional protection. The flap 28 can be opened and closed such that the wearer can gain access to the frontal opening 26. In accordance with a non-limiting embodiment, the flap 28 is closable via a Velcro™ fastener.

The outer jacket 10 can be made of multiple different materials and layers. In a non-limiting embodiment, the outer jacket 10 includes an inner layer and an outer layer. The inner layer typically comprises a moisture barrier fabric sewn together with an aramid facecloth that is quilted to an aramid batting. This provides the outer jacket 10 with thermal insulation. The outer layer is generally made of a woven aramid fiber and/or polybenzamidazole fibers, which provides the jacket 10 with flame, abrasion and pierce resistance. It should be understood that other materials and constructions for jacket 10 could also be considered without departing from the spirit of the invention.

Figure 3:
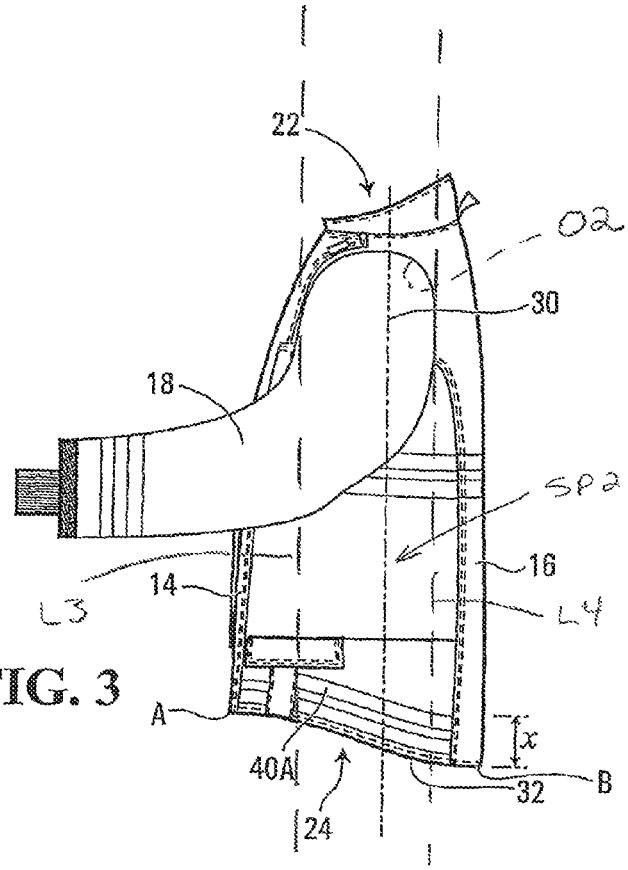
FIG. 3 shows a right side view of the firefighter jacket of FIG. 1.
Figure 4:
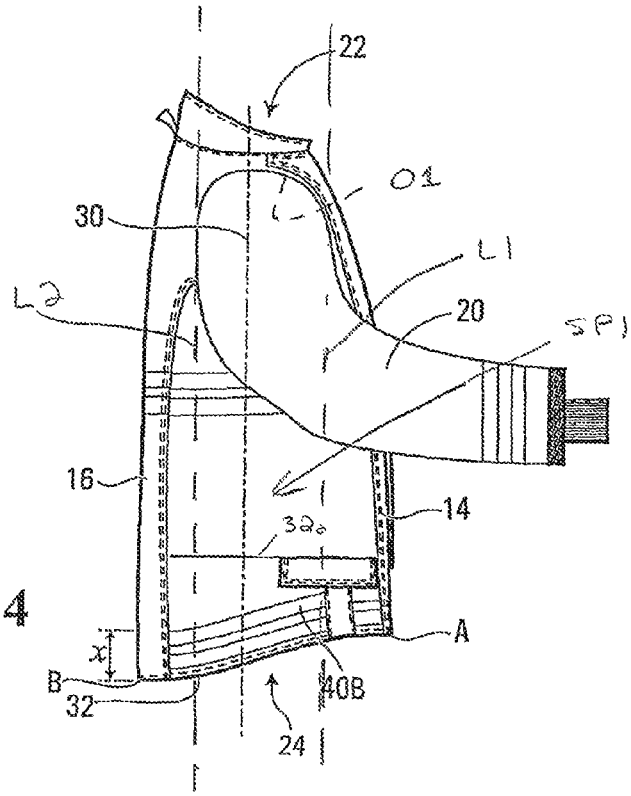
FIG. 4 shows a left side view of the firefighter jacket of FIG. 1.

As shown in FIGS. 2, 3 and 4, the back side 16 of jacket 10 is longer than the front side 14. For the purposes of the present invention, the division between the front side 14 of the jacket 10 and the back side 16 of the jacket 10 occurs at an imaginary line 30 (shown in FIGS. 3 and 4) which is drawn from the point where the sleeves 18 and 20 join the torso-covering portion 20 at the upper arm, to the point where the sleeves 18 and 20 join the torso-covering portion 20 at the underarm. This line can be extended up to the head opening 22 and down to the lower-trunk opening 24. As such, the portion of the torso-covering portion 12 that is forward of this imaginary line 30 is considered the front side 14 of the jacket 10, and the portion of the torso-covering portion 12 that is rearward of this imaginary line 30 is considered the back side 16 of the jacket 10.

In the non-limiting embodiment shown in FIGS. 1, 2, 3 and 4, the outer jacket 10 is constructed from a front panel 34, that is divided into two halves by the frontal opening 26, two side panels 36*a* and 36*b* and a back panel 38. As such, the front panel 34 and a portion of each of the two side panels 36*a* and 36*b* forms the front side 14 of the jacket 10, and the back panel 38 and a portion of each of the two side panels 36*a* and 36*b* forms the back side 16 of the jacket 10. It should be understood that in alternative embodiments of the invention, the jacket 10 may include more or less panels than those shown in FIGS. 1, 2, 3 and 4. The front and back panels 36, 38 each extends across a vertical line centered between the sides of the jacket 10.

As mentioned above, the back-side 16 of the jacket 10 is longer than the front side 14 of the jacket. More specifically, the bottom edge 32 of the jacket tapers downward from the front side 14 of the jacket 10 to the back side 16 of the jacket 10. The top edge 32 is substantially straight over its entire extent and is oriented horizontally. In the non-limiting embodiment shown, the two side panels 36*a* and 36*b* taper downwards from the front panel 34 to the back panel 38, which are each of different lengths. Due to this tapering downwards of the bottom edge 32, there is a difference in length "X" between the bottom edge's highest point A on the front side 14 to the bottom edge's lowest point B on the back side 16. In a preferred embodiment, the difference in length between these two points is in the range of 2 to 8 inches.

As shown in FIGS. 1, 2, 3 and 4 the outer jacket 10 includes two pockets 40*a* and 40*b*. It should be understood that an outer jacket 10 that includes only one pocket, or that includes three or more pockets, is also included within the scope of the present invention.

Each of pockets 40*a* and 40*b* extends from the front side 14 of the outer jacket 10 towards the back side 16 of the outer jacket 10 so as to extend over, and as shown fully across the width of its respective side portion SP1, SP2, and tapers downwardly as it extends from front to back. In the non-limiting embodiment shown, pockets 40*a* and 40*b* form part of the side panels 36*a* and 36*b* respectively.

The pockets will now be described in more detail with reference to the expanded view of pocket 40*a* shown in FIGS. 5A and 5B. For the purposes of simplicity, only pocket 40*a* will be described below. It should be understood, however, that since pockets 40*a* and 40*b* are substantially identical, the following description applies to both pockets 40*a* and 40*b*.

Figure 5A:
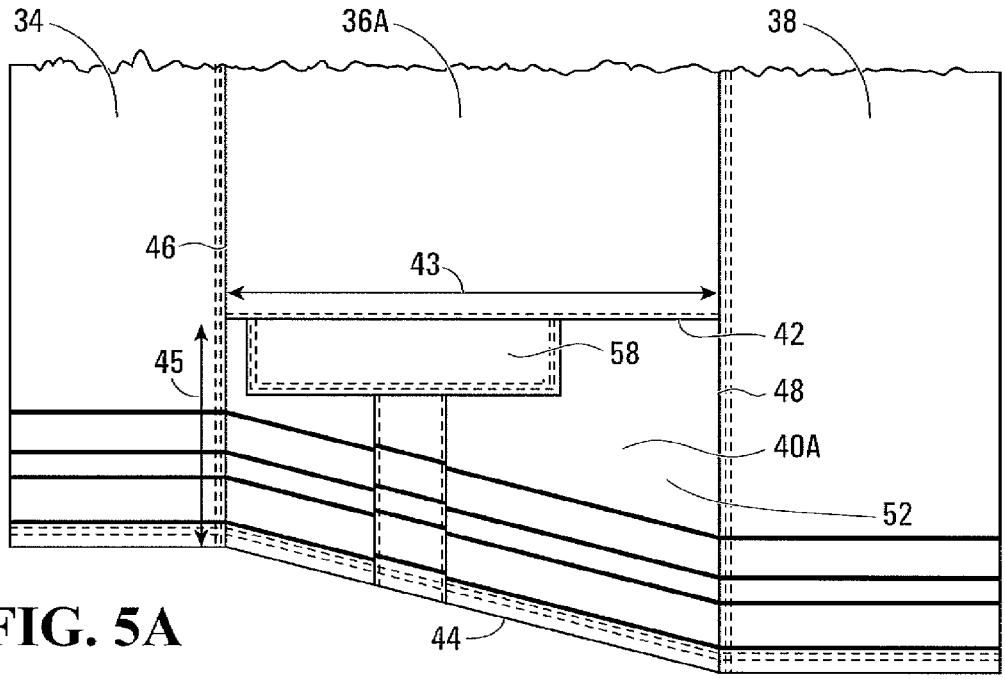
FIG. 5A shows an expanded view of a pocket in accordance with a first non-limiting example of implementation of the present invention, wherein the pocket is in a closed position.
Figure 5B:
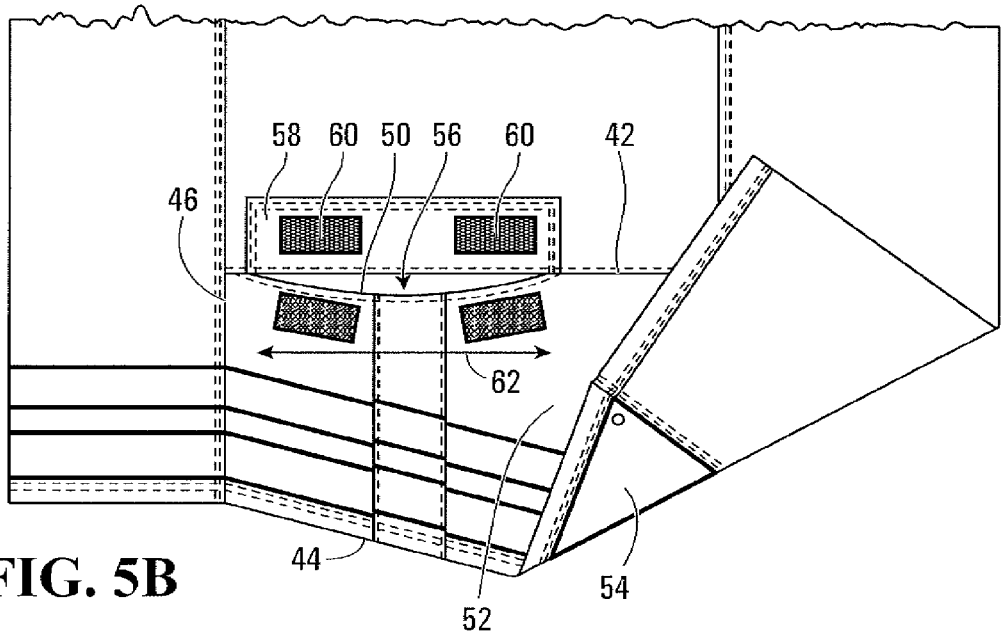
FIG. 5B shows the pocket of FIG. 5A in an open position.

Referring now to FIGS. 5A and 5B, it is shown that pocket 40*a* comprises an interior chamber 56 that is defined by a top edge 42, a bottom edge 44, a frontal side edge 46 and a back side edge 48. The interior chamber 56 is formed between an outer surface 52 and an inner surface 54. Each of the top edge 42, bottom edge 44, frontal side edge 46 and back side edge 48 is formed via a seam joining the outer surface 52 and inner surface 54 together. Pocket 40*a* further comprises an opening 50, such that the wearer can inserts items into, and withdraw items from, the interior chamber 56 of the pocket 40*a*.

In accordance with the present invention, and as shown in FIG. 5A, the interior chamber 56 of the pocket 40*a* has a width 43 and a depth 45, wherein the depth 45 of the interior chamber 56 varies over the width 43 of the pocket 40*a*. In the non-limiting embodiment shown, the depth 45 of the pocket 40*a* increases as the pocket 40*a* extends from the front side 14 of the jacket 10 towards the back side 16 of the jacket 10. As such, the back side edge 48 of the pocket 40*a* is longer than the frontal side edge 46, and the bottom edge 44 is longer than the top edge 42. In addition, the distance between the top edge 42 and the bottom edge 44 of the pocket 40*a* increases as the pocket 40*a* extends from front to back.

In the embodiment shown in FIGS. 5A and 5B, the bottom edge 44 of the pocket is coincident with the bottom edge 32 of the jacket 10, and as such tapers downwardly towards the back side 16 of the jacket 10 along with bottom edge 32. In an alternative example of implementation, the pocket 40*a* can be positioned above the bottom edge 32 of the jacket. In such a case, the bottom edge 44 of the pocket 40*a* may be parallel to the bottom edge 32 of the jacket 10, but not coincident.

The fact that pocket 40*a* increases in depth as it extends towards the back side 16 of the jacket 10 improves the functionality of the jacket in at least two ways. Firstly, the functionality is improved by providing the jacket 10 with a relatively deep pocket in which the firefighter can place his/her tools, while preventing the need for a long front side 14 of the jacket. Since the deepest part of pocket 40*a* is positioned towards the back-side 16 of the jacket, the jacket 10 can have a shorter front side 14, while still having a deep pocket in which long items, such as flashlights and screwdrivers, can be placed. When the front-side 14 of the jacket 10 is shorter in length, the firefighter's ability to move and bend is improved, thereby improving the overall functionality of the jacket 10.

Secondly, the functionality of the jacket is improved by preventing the items placed within pocket 40*a* from bunching up at the front of the jacket 10. By increasing the depth of the pocket 40*a* towards the back side 16 of the jacket 10, the tools placed therein will naturally fall more towards the side and rear of the jacket 10 than the front of the jacket. As such, the items placed within pocket 40*a* do not hinder the frontal bending movement of the firefighter. In addition, safety is improved since sharp objects contained within pocket 40*a* are kept away from the front of the body and are moved off to the side of the jacket where there is no body bending, and thus less risk of injury.

Although in the embodiment shown in the Figures, the bottom edge 44 of the pocket 40*a* tapers continuously downwards until it meets the back side edge 48, it should be understood that other embodiments are included within the scope of the invention. For example the bottom edge 44 may taper downwards towards the back-side 16 of the jacket 10, and then once a certain depth has been reached, the bottom edge 44 may become parallel to the top edge 42 of the pocket. Alternatively, the bottom edge 44 may form a V-shape, such that the deepest portion of the pocket occurs at the mid-point of the pocket. Other embodiments wherein the depth of the pocket varies along the pocket's width are also included within the scope of the present invention.

In accordance with a non-limiting embodiment of the present invention, the outer surface 52 of the pocket 40*a* forms an integral part of the outer surface of the overall jacket 10. In the embodiment shown, pocket 40*a* forms an integral part of the side panel 36*a*. More specifically, pocket 40*a* is not just sewn on top of the outer material of the jacket 10*a*. Instead, the outer surface 52 of pocket 40*a* forms a portion of the outer surface of the overall jacket 10.

Due to the fact that the outer layer 52 of pocket 40*a* is part of the outer surface of the overall jacket, pocket 40*a* does not protrude outwardly as much as a traditional pocket that is sewed directly onto the outer surface of the jacket. This means that pocket 40*a* does not create as big of an outward protrusion when it is filled with items. As such, pocket 40*a* is less likely to snag and catch on things during the course of the firefighter's routine activities, thereby further improving the safety and functionality of jacket 10.

As mentioned above, some of the items that are placed within pockets 40*a* and 40*b* can be very sharp, such as screwdrivers for example. Therefore, in a non-limiting example of implementation, pocket 40*a* includes internal reinforcement such that the sharp objects contained within the pocket cannot pierce through and hurt the wearer. In a non-limiting embodiment, the internal reinforcement consists of a pierce resistant material between the interior chamber 56 of the pocket, and the wearer's body. As such, in accordance with a first embodiment, the inner surface 54 of the pocket 40*a* is formed of an abrasion and pierce resistant aramid material, such as Kevlar® made by Dupont. In this manner, in the case where the firefighter falls down, or has to squeeze through a tight space, he/she will r reduce the risk of being injured by any sharp contents of the pocket that may puncture through the pocket 40*a*. Although Kevlar® is mentioned above, it should be understood that any other pierce resistant material known in the art could also be used without departing from the spirit of the invention.

Furthermore, instead of the inner surface 54 of the pocket 40*a* being formed of pierce resistant material, it is possible that both the outer surface 52 and the inner surface 54 are formed of a non-pierce resistant. In such a case, one or both of the inner layer 54 or the outer layer 52 of the pocket 40*a* could be lined with a pierce resistant material in order to improve the safety of the jacket 10.

In the non-limiting example of implementation shown in FIGS. 5A and 5B, the opening 50 to the interior chamber 56 of pocket 40*a* is covered with a flap 58. The flap 58 serves to prevent water and debris from entering the pocket 40*a*. In the embodiment shown in FIGS. 5A and 5B, the flap includes a fastening device in the form of Velcro™ patches 60 in order to keep the flap closed. It should be understood that other fastening devices know in the art, such as buttons, zippers and snaps, could also be used without departing from the spirit of the invention. In yet another alternative embodiment, it is possible that there is no flap and/or no fastening device at all.

As shown in FIG. 5B, the opening 50 to the interior chamber 56 has a width 62. In accordance with the present invention, the width 43 of the pocket 40*a* is greater than the width 62 of the opening. In the embodiment shown, the opening 50 is positioned on the upper edge 42 of pocket 40*a* closer to the frontal side edge 46 than the back side edge 48. As such, the opening 50 does not extend as far towards the back-side 16 of the jacket 10 as the pocket 40*a*. In this manner, it is easier for the wearer to access the opening 50 for placing and removing items from within pocket 40*a*. It should be understood, however, that the opening 50 could be positioned at other locations without departing from the spirit of the invention.

Figure 6:
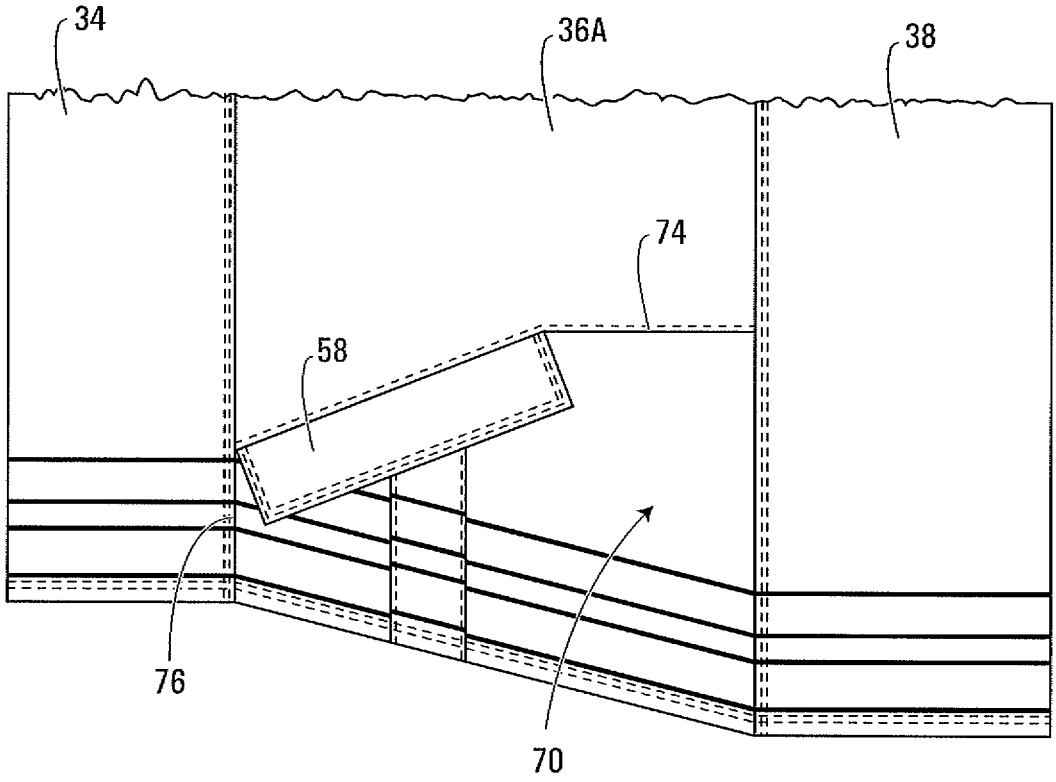
FIG. 6 shows an expanded view of a pocket in accordance with a second non-limiting example of implementation of the present invention, wherein the pocket is in a closed position.

Shown in FIG. 6, is a pocket 70 in accordance with an alternative example of implementation of the present invention. In this embodiment, the opening (not shown) to the pocket 70 is positioned at an angle with respect to the top edge 74 and the frontal side edge 76. In this manner, the opening to the pocket may be easier for the wearer to access.

In many cases, firefighters wear self-contained breathing apparatus in order to assist them in their breathing when they are exposed to smoky air. Such breathing apparatus generally include straps that attach around the wearer's waist. A common problem with existing pockets, is that the waist straps of the firefighter's self-contained breathing apparatus cover the opening to the pockets, thereby preventing the firefighter from gaining access to the pocket easily.

Referring back to FIGS. 1 and 2, it is shown that pockets 40*a* and 40*b* are positioned relatively low on the torso covering portion 12 of jacket 10. As such, in a non-limiting embodiment, the pockets 40*a* and 40*b* are designed to sit below the area where the straps of the firefighter's self-contained breathing apparatus would be positioned. In this manner, access to the pockets 40*a* and 40*b* will not be hindered by the breathing apparatus straps.

Although the pockets 40*a* and 40*b* have been described herein with respect to an outer jacket 10 for a firefighter, it should be understood the pockets according to the present invention that vary in depth along their width could be included within any form of protective garment. For example, such pockets could be included on an inner jacket, on a pair of pants, or on a pair of coveralls, without departing from the spirit of the present invention.

Although the present invention has been described in considerable detail with reference to certain preferred embodiments thereof, variations and refinements are possible without departing from the spirit of the invention. Therefore, the scope of the invention should be limited only by the appended claims and their equivalents.

The invention claimed is:

1. A firefighter jacket comprising:

a. a torso-covering portion having a front and back and comprising:

i. a front-side and a back-side, wherein the back-side is longer than the front-side;

ii. first and second sleeves;

iii. first and second openings at which the first and second sleeves are respectively connected and through which a wearer's arms project into the sleeves with the firefighter jacket worn, the openings each having a diameter;

iv. first and second opposite side portions, the first side portion within a space between parallel vertical lines spaced a distance equal to the diameter of the first opening and containing the first opening, the second side portion within a space between parallel vertical lines spaced a distance equal to the diameter of the second opening and containing the second opening;

b. a first pocket extending from the front-side to the back-side of the torso-covering portion and extending over the first side portion, the pocket comprising:

i. an interior chamber having a width and a depth, wherein:

1. the depth of the interior chamber is greater towards the back-side of the torso-covering portion than towards the front-side of the torso-covering portion, and 2. a bottom edge of the pocket follows a bottom edge portion of the firefighter jacket; and ii. an opening to the interior chamber, the opening extending horizontally.

2. The firefighter jacket as defined in claim 1, wherein during wear of the firefighter jacket, the pocket is positioned on the firefighter jacket substantially below a wearer's waist.

3. The firefighter jacket as defined in claim 1, wherein the pocket comprises a bottom edge that slopes from the front-side of the torso-covering portion towards the back-side of the torso-covering portion, such that the items placed within the pocket during wear of the firefighter jacket are caused to locate themselves towards the back-side of the torso-covering portion.

4. The firefighter jacket as defined in claim 1, wherein the bottom edge of the pocket is generally coincident with a bottom edge of the torso-covering portion.

5. The firefighter jacket as defined in claim 1, wherein the bottom edge of the pocket follows a bottom edge of the torso-covering portion at a position above the bottom edge of the torso-covering portion.

6. The firefighter jacket as defined in claim 1, wherein the pocket comprises a frontal side edge and a back side edge, the back side edge of the pocket being longer than the frontal side edge.

7. The firefighter jacket as defined in claim 1, wherein the opening is positioned along a top edge of the pocket.

8. The firefighter jacket as defined in claim 1, wherein the pocket has a first width, and the opening has a second width, the first width being greater than the second width.

9. The firefighter jacket as defined in claim 1, wherein the pocket includes internal reinforcement.

10. The firefighter jacket as defined in claim 1, wherein the pocket is a first pocket, the firefighter jacket further comprising a second pocket.

11. The firefighter jacket according to claim 1 wherein the pocket extends over an entire width of the first side portion between the parallel vertical lines containing the first opening.

12. The firefighter jacket according to claim 1 wherein the pocket has a front and rear and the opening is closer to the front of the pocket than the rear of the pocket.

13. The jacket according to claim 1 wherein the pocket has a top edge with an extent and the top edge is straight over the full extent of the top edge.

14. A firefighter jacket comprising:

a. a torso-covering portion having a front and back and comprising:

i. a front-side and back-side, wherein the back-side is longer than the front-side;

ii. first and second sleeves;

iii. first and second openings at which the first and second sleeves are respectively connected and through which a wearer's arms project into the sleeves with the firefighter jacket worn, the openings each having a diameter;

iv. first and second opposite side portions, the first side portion within a space between parallel vertical lines spaced a distance equal to the diameter of the first opening and containing the first opening, the second side portion within a space between parallel vertical lines spaced a distance equal to the diameter of the second opening and containing the second opening;

b. at least one pocket that extends from the front-side of the torso-covering portion to the back-side of the torso-covering portion a distance greater than a width of each of the first and second side portions between the parallel vertical lines, each of the at least one pockets comprising:

i. an interior chamber having a width and a depth, wherein the depth increases from the front-side to the back-side of the torso-covering portion;

ii. a bottom edge that slopes from the front-side of the torso-covering portion towards the back-side of the torso-covering portion, such that items placed within the at least one pocket during wear of the firefighter jacket are caused to locate themselves towards the back-side of the torso-covering portion.

15. The firefighter jacket as defined in claim 14, wherein during wear of the firefighter jacket, each of the at least one pockets is positioned on the firefighter jacket substantially below a wearer's waist.

16. The firefighter jacket as defined in claim 14, wherein the bottom edge of each of the at least one pockets is generally coincident with a bottom edge of the torso-covering portion.

17. The firefighter jacket as defined in claim 14, wherein the bottom edge of each of the at least one pockets follows a bottom edge of the torso-covering portion at a position above the bottom edge of the torso-covering portion.

18. The firefighter jacket as defined in claim 14, wherein each of the at least one pockets comprises a frontal side edge and a back side edge, the back side edge of each of the at least one pockets being longer than the frontal side edge.

19. The firefighter jacket as defined in claim 14, wherein each of the at least one pockets further comprises an opening to the interior chamber.

20. The firefighter jacket as defined in claim 14, wherein each of the at least one pockets has a first width, and the opening has a second width, the first width being greater than the second width.

21. The firefighter jacket according to claim 14 wherein the pocket extends over the entire width of one of the first and second side portions.

22. The firefighter jacket according to claim 14 wherein the pocket has an opening to the interior chamber that extends horizontally.

23. A firefighter jacket comprising:

a. a torso-covering portion having a front and back and comprising:

i. a front-side and back-side, wherein the back-side is longer than the front-side;

ii. first and second sleeves;

iii. first and second openings at which the first and second sleeves are respectively connected and through which a wearer's arms project into the sleeves with the firefighter jacket worn, the openings each having a diameter;

iv. first and second opposite side portions, the first side portion within a space between parallel vertical lines spaced a distance equal to the diameter of the first opening and containing the first opening, the second side portion within a space between parallel vertical lines spaced a distance equal to the diameter of the second opening and containing the second opening;

b. a pocket extending from the front-side of the torso-covering portion to the back-side of the torso-covering portion and fully across a width of the first side portion between the parallel vertical lines at the first opening, the pocket comprising:

i. an interior chamber having a width and a depth, wherein the depth of the interior chamber is greater towards the back-side of the torso-covering portion than towards the front-side of the torso-covering portion;

ii. a frontal side edge and back side edge, the back side edge of the pocket being longer than the frontal side edge;

iii. a pleat positioned between the frontal side edge and the back side edge.

24. The firefighter jacket as defined in claim 23, wherein the pleat comprises a bottom edge that slopes from the front-side of the torso-covering portion towards the back-side of the torso-covering portion.

25. The firefighter jacket according to claim 23 wherein the pocket has an opening to the interior chamber that extends horizontally.

26. A firefighter garment comprising:

a. a jacket having a front, a back, and spaced sides and comprising:

b. a torso-covering portion with first and second spaced openings at the sides of the jacket each for a wearer's arm and configured to cover the torso of a firefighter wearing the jacket, the torso-covering portion comprising a front section comprising one panel and a back section comprising another panel, the one panel and another panel being joined together by a first side panel and a second side panel, the one, another and first and second side panels all separately formed from each other and joined together, the first and second side panels being joined to the one panel along respective front seams, and the first and second side panels being joined to the another panel along respective back seams, the front seams and the back seams extending to a bottom edge of the torso-covering portion, the one and another panels extending across vertical lines centered between the sides of the jacket respectively at the front and back of the jacket;

c. at least one pocket, each of the at least one pocket comprising:

i. an interior chamber having a width and a depth, wherein:

1. the depth varies along the width, and 2. the width extends along the first side panel from one of the front seams to one of the back seams so that the one of the front seams and one of the back seams both define the pocket width and join the first side panel to each of the one and another panels; and an opening to the interior chamber.

27. A firefighter garment comprising:

a. a jacket having a front and back and spaced sides and comprising:

b. a torso-covering portion with first and second spaced openings at the sides of the jacket each for a wearer's arm and configured to cover the torso of a firefighter wearing the jacket, the torso-covering portion comprising a front-side and a back-side each having a bottom edge portion, wherein the back-side is longer than the front-side, such that the bottom edge portion of the front-side extends downwards towards the bottom edge portion of the back-side;

c. at least one pocket positioned on the torso-covering portion, each of the at least one pocket comprising:

i. a top edge, a bottom edge, a frontal side edge, and a back side edge, wherein the bottom edge of said pocket is generally coincident with the bottom edge portion of the jacket so that the bottom edge of the pocket extends downwards towards the bottom edge of the back-side;

ii. an interior chamber having a width and a depth, wherein the depth increases from the frontal side edge to the back side edge, iii. an opening to the interior chamber, the opening to the interior chamber extending horizontally and being accessible to a wearer of the firefighter jacket from the front-side of the torso-covering portion.

* * * * *